United States Patent [19]

Sanchez

[11] Patent Number: 4,480,846

[45] Date of Patent: Nov. 6, 1984

[54] BASE PANEL RETAINING BABY WALKER AGAINST MOVEMENT

[76] Inventor: Gilbert A. Sanchez, 1411 Mitchell Pl., Los Angeles, Calif. 90033

[21] Appl. No.: 486,568

[22] Filed: Apr. 20, 1983

Related U.S. Application Data

[63] Continuation-in-part of Ser. No. 404,644, Aug. 2, 1982, abandoned.

[51] Int. Cl.[3] ..... B62M 1/00

[52] U.S. Cl. ..... 280/87.02 W; 188/174; 248/346; 280/289 WC

[58] Field of Search ..... 280/87.02 W, 259 WC, 280/7.1, 7.12, 13, 43.14, 43.24, 8, 825, 643; 248/346; 297/DIG. 4; 182/15, 17; 188/176, 174, 20, 29

[56] References Cited

U.S. PATENT DOCUMENTS

| | | | |
|---|---|---|---|
| 2,198,813 | 4/1940 | Hall | 280/7.1 |
| 2,380,162 | 7/1945 | Germain | 280/8 |
| 2,425,253 | 8/1947 | Little | 280/7.1 |
| 2,426,432 | 8/1947 | Breckner | 280/7.1 |
| 2,532,004 | 11/1950 | Zepp | 280/7.1 |
| 2,665,742 | 1/1954 | Starysky | 280/7.1 |
| 3,861,697 | 1/1975 | Dolce | 280/825 |
| 4,191,391 | 3/1980 | Dorlini | 280/9 |
| 4,231,582 | 11/1980 | Moss | 280/87.02 W |

*Primary Examiner*—Joseph F. Peters, Jr.
*Assistant Examiner*—Joseph G. McCarthy
*Attorney, Agent, or Firm*—William P. Green

[57] ABSTRACT

A wheeled baby walker is adapted to be rendered immobile by positioning a base panel at a location to be received beneath the feet of a baby supported by the walker, with the panel being supported on a floor or ground surface independently of the wheels of the walker, and with the panel engaging the walker in a manner preventing the walker from moving horizontally relative to the panel.

15 Claims, 11 Drawing Figures

FIG. 8
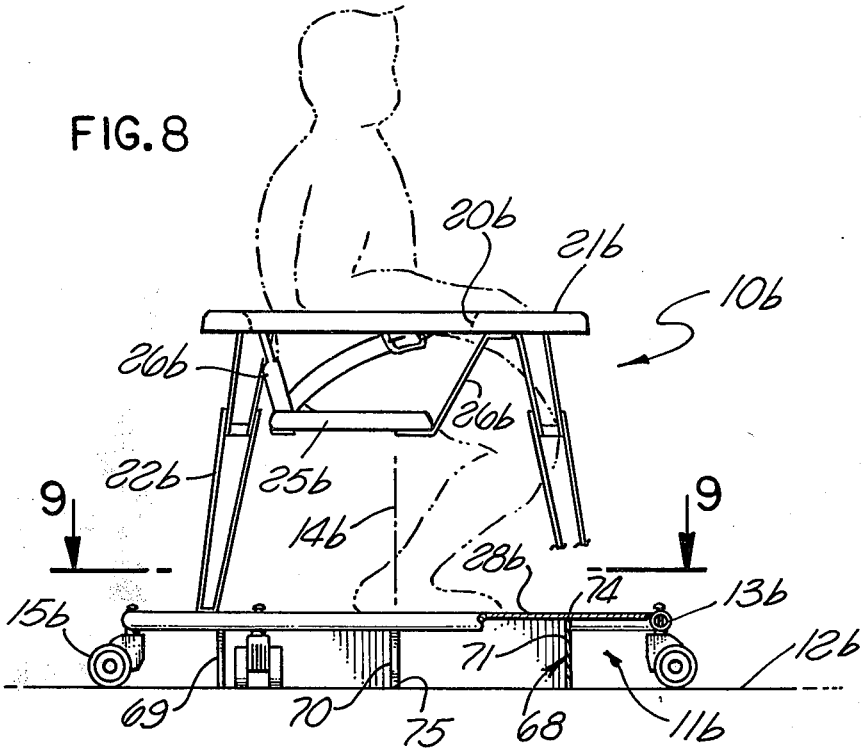
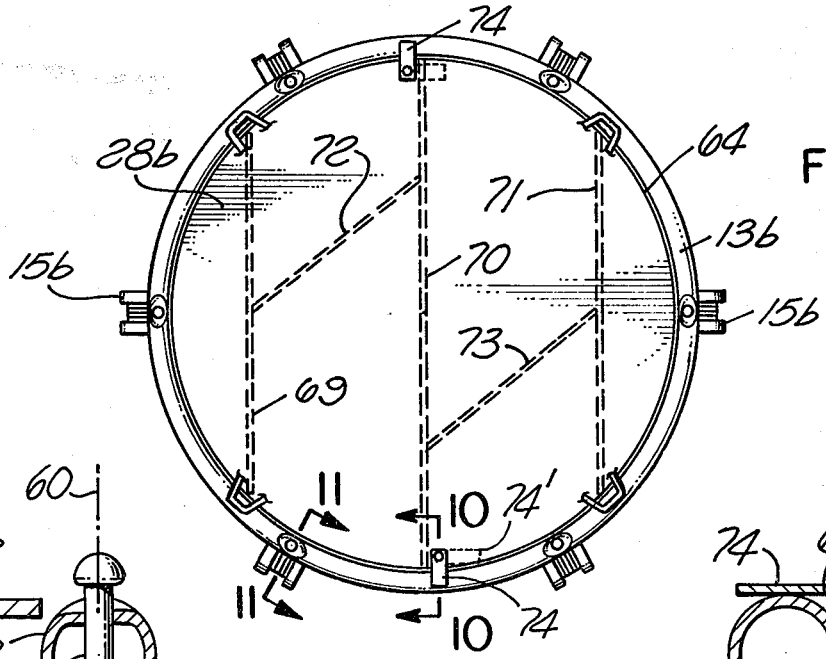
FIG. 9
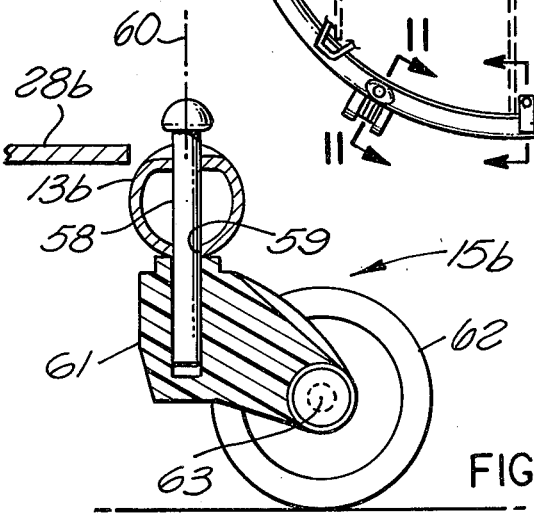
FIG. 11
FIG. 10
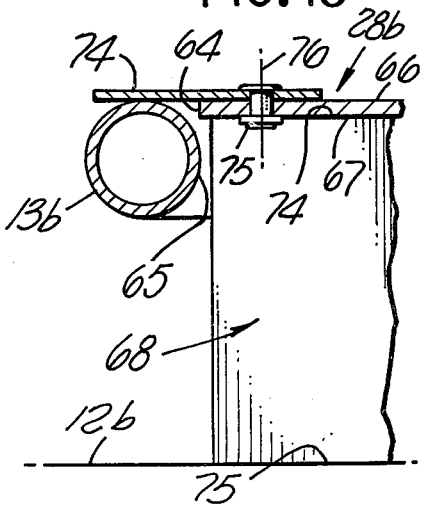

BASE PANEL RETAINING BABY WALKER AGAINST MOVEMENT

BACKGROUND OF THE INVENTION

This application is a continuation-in-part of my copending application Ser. No. 404,644 filed Aug. 2, 1982 on "Baby Walker Rendered Immobile by Base Panel", now abandoned.

This invention relates to improvements in baby walkers, and in particular to means for effectively retaining a walker against movement along a floor or ground surface when desired.

There have in the past been devised various types of baby walkers, consisting of structures which are mounted on wheels to roll along a floor surface and which include a seat or other means adapted to assist in supporting the weight of a baby at a predetermined location relative to the device, and in a position in which the feet of the baby can contact the surface of the floor on which the walker is positioned in a relation enabling the baby to propel the walker along the floor surface. The device thus permits a baby not yet capable of walking without assistance to move to different positions, giving him exercise and enjoyment and facilitating the process of learning to walk. A disadvantage of such walkers, however, is that they may under some circumstances render the child more mobile than would be desired, and may be dangerous by permitting him to approach too closely to objects which can harm him, or may permit him to break or damage items which he could not reach without the mobility afforded by the walker.

SUMMARY OF THE INVENTION

The general purpose of the present invention is to provide a walker which can easily and effectively be converted from a normal fully mobile condition to a stationary condition in which the mounting wheels can no longer roll along a floor surface but instead the device is very positively retained in any desired fixed position to prevent unwanted movement of the child and assure that he remain at that location in which he can do not harm to himself or items around him. This result is achieved by providing a base panel which is adapted to be positioned at a location of extension generally horizontally beneath a baby supported in an associated walker, with the panel being supported from the floor surface independently of the wheels of the walker. That is, the panel is not supported by those wheels but rather directly from the floor. When the panel is in use, it is so positioned that the feet of the child supported by the walker contact the panel rather than the floor surface. The panel is constructed to engage the walker in a relation preventing movement of the walker horizontally relative to the panel, with the result that a baby supported by the walker can not propel the walker relative to the panel or relative to the floor surface, and the walker therefore remains in fixed position as desired. The connection between the panel and the walker may include means associated with these two units and adapted to interfit, preferably as a result of movement of the walker downwardly relative to the panel. In one form of the invention, connector means are provided on the panel forming an upwardly facing recess or recesses into which a portion of the walker is movable downwardly in an interfitting relation locking the walker against horizontal movement relative to the panel. In another form of the invention, the wheels of the walker may move downwardly into openings formed in the panel to attain the desired interfitting relationship. In a third arrangement, the walker has a portion received essentially about the panel in a relationship preventing the movement.

BRIEF DESCRIPTION OF THE DRAWINGS

The above and other features and objects of the invention will be better understood from the following detailed description of the typical embodiments illustrated in the accompanying drawings, in which:

FIG. 8 is a side elevational view, partly in section, of a third form of the invention;

FIG. 9 is a horizontal section taken on line 9—9 of FIG. 8; and

FIGS. 10 and 11 are enlarged fragmentary vertical sections taken on lines 10—10 and 11—11 respectively of FIG. 9.

DESCRIPTION OF THE PREFERRED EMBODIMENTS

Figure 1:
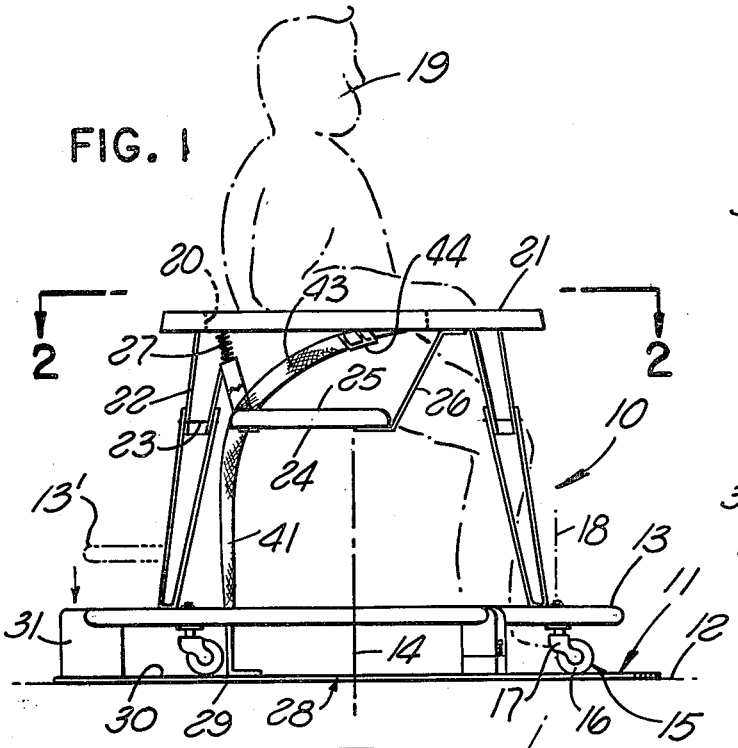
FIG. 1 is a side elevational view showing a first form of baby walker and base panel assembly constructed in accordance with the invention.

The combination illustrated in FIGS. 1 to 5 includes a baby walker 10 of a known conventional type, and a device 11 utilizable in conjunction with walker 10 for retaining it in fixed position on a floor or ground surface 12.

The illustrated walker 10 has a frame including a ring 13 which may be formed of metal tubing, and which extends annularly about a vertical axis 14. Ring 13 carries a series of circularly spaced casters 15, typically four in number, whose wheels 16 are adapted in the normal mobile condition of the walker to directly engage floor surface 12 and thus mount the walker for movement to different positions along that floor surface. The casters may be of any conventional construction, including carrier bodies 17 which are connected to ring 13 to pivot relative thereto about individual vertical axes 18 of the casters, with the wheels 16 being mounted to the caster bodies 17 for rotation relative thereto about individual horizontal axes.

The baby 19 is supported within an opening 20 in an upper horizontal top or tray portion 21 of the device. This top 21 is connected to and supported by ring 13 by a plurality of legs or support members 22, which may converge gradually and slightly as they advance upwardly, and which may be foldable at a joint 23 to enable the top 21 to be retracted downwardly to a folded position within ring 13 to facilitate transportation of the device from place to place.

The child is supported from top 21 in a position such as that illustrated in FIG. 1 by a structure 24 suspended from the top 21. This structure may include a seat 25 on which the baby can sit, suspended from top 21 by a number of circularly spaced straps 26, one or more of which may be connected to the top by springs 27 giving some resilience to the support of the seat. When the unit 10 is in use as a walker, with wheels 16 directly contacting the floor surface, the feet of the baby are free to engage the floor surface and by reaction thereagainst propel the walker 10 along the floor surface in any desired direction.

Figure 3:
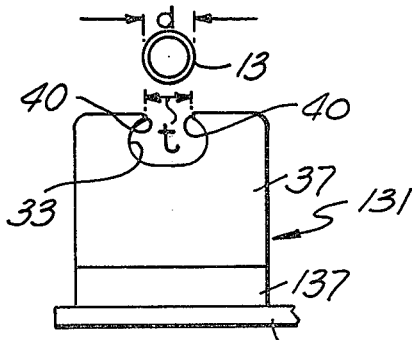
FIGS. 3 and 4 are vertical sections taken on lines 3—3 and 4—4 respectively of FIG. 2.
Figure 4:
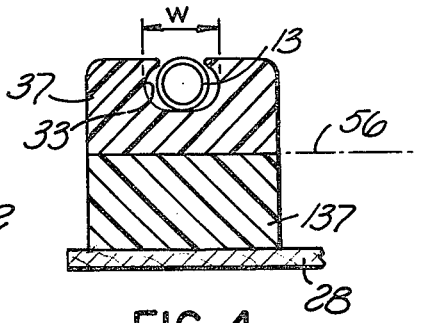
Figure 2:
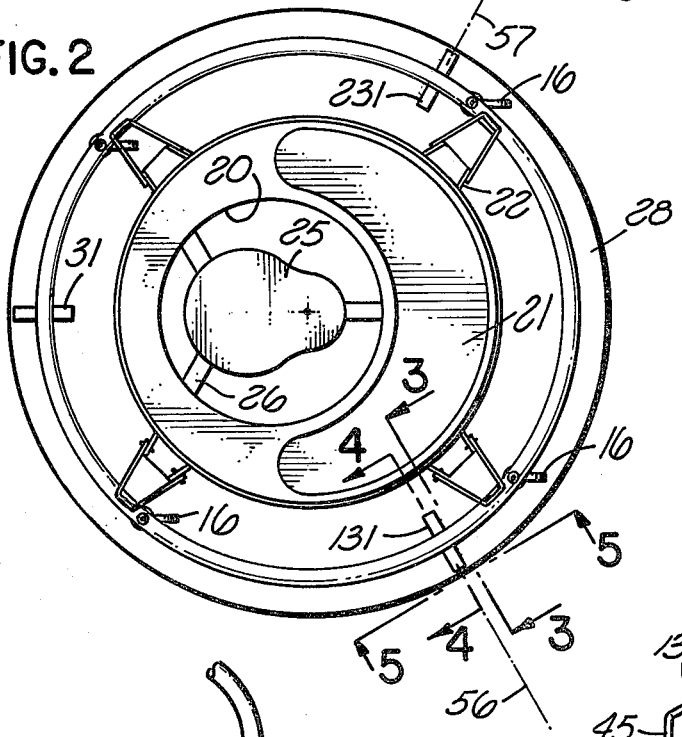
FIG. 2 is a plan view taken on line 2—2 of FIG. 1.
Figure 5:
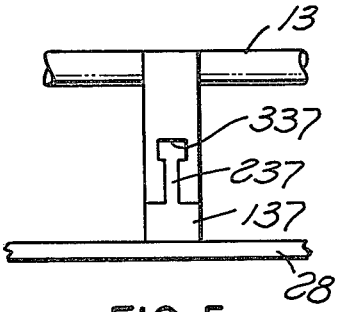
FIG. 5 is a view taken on line 5—5 of FIG. 2.

The device 11 for rendering the walker immobile includes a preferably circular horizontal panel 28 having a planar under-surface 29 for engaging floor surface 12 and supporting the panel thereon, and having a planar upper surface 30 parallel to the floor. The circular panel 29 is centered about the previously mentioned axis 14 of ring 13, and may be of a diameter just slightly greater than that of the ring. At several evenly circularly spaced locations (preferably three such locations), panel 28 carries a number of upwardly projecting connector posts or elements 31, 131 and 231, to which the walker 10 is detachably connectable in the FIG. 1 condition of the apparatus to retain the walker against horizontal movement relative to the base device 11. At least one of these posts, say for example post 31, may be formed as a single body of rigid material attached to panel 28 in fixed position. The other two posts 131 and 231 may also be formed as one piece rigid elements if the device 11 is always to be used with a walker having a ring 13 of a particular known diameter. Alternatively, if the device may be used with walkers having rings of slightly different sizes, an adjustment can be provided by forming posts 131 and 231 sectionally as illustrated in FIGS. 3, 4 and 5, to include lower parts 137 attached in fixed position to panel 28 and upper parts 37 connected to parts 137 for adjusting movement relative thereto along two radial horizontal axes 56 and 57 extending perpendicular to and intersecting central vertical axis 14. This adjustable connection may be formed by providing each part 137 with an upwardly projecting tongue 237 of T-shaped cross section transversely of axis 56 or 57 (FIG. 5) slidably received within a groove 337 of corresponding cross section in part 37. The fit between the parts at this sliding connection may be tight enough to normally retain the upper parts 37 frictionally in fixed positions relative to parts 137 while permitting forced sliding adjustment of the parts 37 when desired in order to accurately position them for engagement with ring 13 of the walker as illustrated.

At their upper sides, the integral post 31 and the upper sections 37 of posts 131 and 231 each contain an upwardly facing groove 33 (FIG. 4) dimensioned to receive ring 13, so that the ring may be moved downwardly from the broken line position 13' of FIG. 1 into all of the grooves 33 of the three posts 31, 131 and 231 to an interfitting position in which the posts act to confine the ring within the grooves 33 and against substantial horizontal movement relative thereto to thereby hold the entire walker in essentially fixed position relative to panel 28. All of the grooves 33 may be slightly curved arcuately about the vertical axis 14 of the device in correspondence with the curvature of ring 13 to receive the ring as discussed. In the FIG. 1 position in which the walker is connected to and retained in position by panel 28, caster wheels 16 may be received just slightly above the upper surface 30 of panel 28, or be lightly in contact therewith.

Appropriate means are desirably provided for releasably locking or retaining ring 13 in its connected position within the grooves in posts 31. In FIGS. 1 through 4, this result is attained by forming part 31 and the two parts 37 which contain the grooves of slightly resiliently deformable resinous plastic material and shaping them to have a snap detenting engagement with the ring. For this purpose, each of these parts is shaped to have upper detenting portions 40 at opposite sides of its recess 33 projecting to a spacing t which is slightly less than the horizontal width d of the cross section of ring 13, so that as the ring moves downwardly into grooves 33 the two portions 40 must be forced slightly apart by the ring to pass it downwardly. After the ring has moved downwardly beyond the reduced width throat formed by detenting portions 40 of parts 31 and 37, those portions 40 return toward one another to their initial spacing by virtue of the resilience of the material of the parts, and thereafter yieldingly retain ring 13 in its confined position within grooves 33 until the ring is subsequently forcibly pulled upwardly through the restricted throat and out of its interfitting connected condition with respect to base panel device 11. The detenting portions 40 may be slightly rounded in vertical section, to form a throat with tapering camming surfaces both above and beneath the point of minimum restriction so that the rounded ring 13 can effectively cam portions 40 apart both upon downward movement and upon upward movement of the ring. The maximum width w of each groove beneath throat portions 40 may be great enough to allow use of the base device 11 with walkers having rings 13 made of slightly different diameters of tubing.

In conjunction with the parts thus far described, there may also be provided a flexible strap 41 (FIG. 1) which is connected at its lower end 42 to the base panel 28, and whose upper end portion 43 is adapted to extend about the body of baby 19, and which has a buckle 44 connecting the end of the strap to another portion of the strap in a manner forming a loop encircling the baby and holding it in position in the device.

To recapitulate the manner of use of the device illustrated in FIGS. 1 to 5, assume that initially the walker is to be utilized in conventional manner for supporting the child 19 while he and the walker move about on a floor surface. In this condition, the walker is placed directly on floor surface 12, with wheels 16 contacting that surface and free to move therealong in any direction. The base panel device 11 is in this condition entirely separated from the walker and not in use, and the buckle 44 is released so that strap 41 can be separated from the baby and remain attached at 42 to device 11. The baby is supported on seat 25, with his feet contacting the floor surface, and by movement of his feet he is able to propel the walker along the floor.

When it is desired to prevent such movement and hold the walker in a fixed position on the floor, the device 11 is placed on the floor as illustrated in FIG. 1, with panel 28 contacting the floor and resting thereon, after which the walker 10 is held in a position above panel 28, with ring 13 received above all of the grooves 33 in the support posts 31, 131 and 231, and the walker is then pressed downwardly to move the ring 13 simultaneously into all of the grooves 33, forcing the ring past the restricted detenting portions 40 of parts 31 and 37, to snap the ring into the FIG. 1 retained position of connection to the base device 11. Thereafter, the detenting portions effectively hold the ring and the remainder of the walker in the FIG. 1 position of connection to base device 11. With the parts in this relationship, the feet of a baby sitting on seat 25 can not contact the floor 12 but can only contact the upper surface of panel 28. Any attempt which the baby makes to move the walker horizontally relative to panel 28 by force exerted against the panel by the baby's feet is resisted by virtue of the effective interfitting and interconnected relationship of ring 13 with respect to posts 31, 131 and 231 and the remainder of the panel assembly. The portion of ring 13 which is received within the fixed integral post 31 is very positively locked by that post against horizontal movement in any direction. The portions 37 of posts 121 and 231 are free for radial adjusting movement as previously discussed, to allow adjustment of the device for use with walkers having rings 13 of slightly different sizes, but since the engagement of the ring with post 31 prevents such radial movement of the ring at posts 131 and 231 the three posts function together to locate the ring and the remainder of the walker against movement in any direction relative to the base panel. The baby thus can not move the walker relative to the panel, and can not move the walker relative to the floor, but instead is very positively retained in a fixed position on the floor.

During connection of the walker to the base unit 11, a person can easily hold and manipulate the walker by grasping its top 21, and lower the walker into its position of connection to base 11 by forcing top 21 downwardly. When it is desired to detach the walker from base 11, a person can stand on portions of panel 28, and then pull upwardly on the walker by exertion of upward force against top 21, to thus force ring 13 out of its contained position within the grooves in posts 31, 131 and 231 and allow the walker to again be placed directly on the floor surface for movement therealong.

Figure 7:
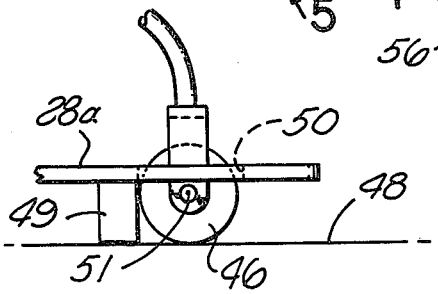
FIG. 7 is an enlarged fragmentary vertical section taken on line 7—7 of FIG. 6.
Figure 6:
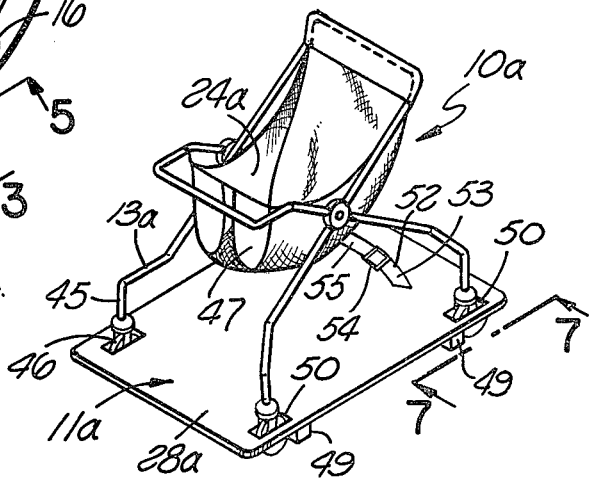
FIG. 6 is a perspective view of a second form of the invention.

The variational arrangement illustrated in FIGS. 6 and 7 includes a different type of walker 10*a* consisting of a foldable frame 13*a* having four legs 45 carrying wheels 46 which contact a floor surface 48 to support the walker for movement along the floor surface. Frame 13*a* of the walker also carries a seat 24*a* in which a baby may be placed with his legs projecting through openings 47. A base device 11*a* is provided for retaining the walker against movement when desired. In the normal condition of the FIG. 6 device, when the walker is utilized without base unit 11*a*, the feet of a baby positioned in seat 24*a* are able to contact a floor surface 48 on which the walker is positioned, enabling the baby to exert force against the floor for rolling the walker in any direction.

Base unit 11*a* in this form of the invention includes a flat horizontal panel 28*a* which is typically rectangular as shown and is supported on floor surface 48 by legs or members 49 attached to panel 28*a* and projecting downwardly therefrom. These legs 49 may take the form of two members extending transversely across the underside of panel 28*a* and typically being of uniform cross section along their entire length to effectively support the panel on the floor surface.

The panel 28*a* contains four openings or elongated slots 50 dimensioned to closely receive the four wheels 46 respectively of the walker, in an interfitting relation preventing horizontal movement of the wheels within openings 50 and relative to panel 28*a*. The legs 49 are desirably of a height locating the panel at or above the level of the horizontal axes 51 about which wheels 46 of the walker turn when the wheels and legs 49 are both in contact with the floor surface (FIG. 7). When the walker is in this interfitting relationship with respect to base unit 11*a* and its panel 28*a*, the seat 24*a* is so located that the feet of a baby positioned in the seat will contact the upper surface of panel 28*a*, and are prevented by that panel from contacting floor surface 48. The baby can thus not exert propelling force against the floor, and any force exerted against the panel 28*a* is ineffective to move the walker relative to that panel by virtue of the interfitting relationship between the walker and panel locking the walker in position relative to the panel.

The walker may further be secured to the panel by a strap 52 having its lower end 53 attached to the panel and having its upper end detachably connectible by a buckle 54 to a strap 55 hanging downwardly from seat 24*a*. This flexible strap assembly 52–55 prevents movement of the walker upwardly relative to the panel far enough to remove wheels 46 from within openings 50, thus assuring maintenance of the interfitting relationship between the walker and panel.

In using the device 10*a* of FIGS. 6 and 7 as a movable walker, it is placed directly on floor surface 48 with base unit 11*a* completely removed from the walker. The wheels 46 are then free to roll along the floor surface in any desired direction, and the baby can effect such movement by exertion of propelling force against the floor through his feet. When it is desired to lock the walker in a fixed position, a person may place the base unit 11*a* on a floor surface, and then hold walker 10*a* in a position above panel 28*a*, and lower the walker to bring the four wheels 46 into the four slots 50 respectively in panel 28*a*, and to a position in which the wheels 46 of the walker and the legs 49 of the base unit simultaneously contact floor surface 48. A baby in seat 24*a* can then only contact panel 28*a* with his feet, and thus can not propel the device by exertion of force against the floor. Any exertion of force against the panel can not be effective to move the walker because it is locked in fixed position relative to the panel. The two straps 52 and 55 may or may not be connected together by buckle 54 to further enhance the effectiveness with which the walker is secured to the panel.

The third form of the invention illustrated in FIGS. 8 through 11 includes a walker 10*b* which is very similar to walker 10 of FIGS. 1 through 5 but interfits with a different type of device 11*b* for releasably retaining the walker against horizontal motion along floor surface 12*b*. As in the first form of the invention, walker 10*b* includes a ring 13*b* preferably formed of metal tubing and supported at a level above and parallel to floor surface 12*b* by several (typically six) casters 15*b*. Each caster is illustrated as including a vertical pin 58 (FIG. 11) extending vertically through openings 59 in the tubular wall of ring 13*b* in a relation mounting the caster for pivotal movement relative to the ring about a vertical axis 60. The caster assembly also includes a carrier body 61 secured to the lower end of pin 58 for rotation about axis 60 therewith and mounting a pair of floor engaging wheels 62 for rotation relative to body 61 about a horizontal axis 63.

The horizontal top or tray portion 21*b* of the walker is supported by ring 13*b* through a plurality of legs or support members 22*b*, and contains an opening 20*b* within which a baby is supported on a seat 25*b* suspended from top 21*b* by straps 26*b*.

The device 11*b* for holding walker 10*b* against horizontal movement on floor surface 12*b* includes a flat horizontal panel 28*b* which is supported at a level above floor surface 12*b* and is preferably circular about the main central vertical axis 14*b* of the walker and support device 11*b*. More particularly, panel 28*b* may have a peripheral edge 64 which may extend vertically as illustrated in FIGS. 10 and 11 and extends circularly about axis 14*b*. The diameter of panel 28*b* and its circular peripheral edge 64 is just slightly less than the minimum internal diameter of ring 13*b*, which is also centered about axis 14*b*. Also, in the active holding position of the device 11*b* as illustrated in FIG. 8, panel 28*b* is at the same level as ring 13*b*, to be received within that ring in a relation enabling the edge 64 of the panel to engage the ring 13*b* (FIGS. 10 and 11) and thereby lock the walker against any substantial horizontal motion relative to the device 11*b*.

Panel 28*b* may be formed of a flat sheet of wood or other material, defined by parallel horizontal upper and lower surfaces 66 and 67. The panel is supported at the FIG. 8 position above floor surface 12*b* by providing the device 11*b* with a support structure 68 secured to the underside of the panel adapted to engage the floor surface and be supported thereby. This structure 68 typically includes three parallel vertical wall elements 69, 70 and 71 formed of wood or other material and projecting downwardly from the panel in the pattern illustrated in FIGS. 8 and 9. Two diagonally extending additional walls 72 and 73 may be secured at their opposite ends to walls 69, 70 and 71 as illustrated in FIG. 9, and extend at an oblique angle thereto to produce an overall structure of maximum rigidity. The upper edges 74 of all of the elements 69, 70, 71, 72 and 73 extend horizontally and engage and are secured to the underside of panel 28*b*, while the bottom edges 75 of wall elements 69, 70, 71, 72 and 73 may extend horizontally and in a common plane for engagement with floor surface 12*b* to support the entire structure 11*b* thereon. The elements 69 through 72 may be secured to one another and to panel 28 in any convenient manner, as by nails and/or an appropriate adhesive.

The walker may be retained against removal upwardly from about device 11 by provision on panel 28*b* of one or more locking elements 74 (preferably 2 such elements at diametrically opposite locations). Each of these elements may take the form of a rigid flat part as shown, connected by a pivot pin 75 to panel 28*b* for swinging movement about a vertical axis 76 between the FIG. 10 position of extension across the upper side of an adjacent portion of ring 13*b* and an inwardly retracted position (broken lines 74' in FIG. 9) in which element 74 is above only the panel and does not overlie ring 13*b*. When both of the elements 74 are in this retracted or inactive position, the walker can be moved upwardly and downwardly relative to device 11 and into and out of engagement therewith. As will be understood, the height of the support structure 68 of device is just great enough to support panel 28 and locking elements 74 at the level illustrated in FIGS. 10 and 11 relative to the walker when both the device 11 and casters 15*b* of the walker are in engagement with the same floor surface 12*b*.

When the walker 10*b* of FIGS. 8 through 11 is used without the holding device 11*b*, casters 15*b* enable the walker to be moved in conventional manner along floor surface 12*b* by action of the baby's feet against the floor surface. When it is desired to lock the walker against such horizontal movement, the device 11*b* is placed on the floor and the walker is then moved downwardly along axis 14 (with locking elements 74 swung to their broken line inactive positions 74' of FIG. 9) to the position illustrated in FIGS. 8 through 11 in which ring 13*b* of the walker is received about panel 28*b*, with the peripheral edge 64 of panel 28*b* received in close proximity to the inner surface of ring 13*b* about the entire circular extent of these parts, with the result that the panel in this interfitting relationship with the walker effectively prevents any horizontal movement of the walker relative to the base panel device 11*b*. Further, the panel 28*b* is at a location preventing engagement of the baby's feet with floor surface 12*b*. If the baby in seat 25*b* attempts to contact the floor, his feet can only engage panel 28*b* and by pressing downwardly on the panel the baby tends to increase the friction between the lower support structure 68 of device 11*b* and further lock that device and the walker against horizontal movement.

The walker is retained in its discussed interfitting relationship with respect to base panel device 11*b* by swinging locking elements 74 from their broken line positions of FIG. 9 to their full line positions of that figure and FIG. 10, in which condition elements 74 block upward movement of ring 13*b* relative to panel 28*b*, and thus prevent the walker from being withdrawn upwardly relative to device 11*b*. This locked condition can be released at any time by merely swinging elements 74 back to their broken line positions of FIG. 9, enabling the walker to be withdrawn freely upwardly relative to and away from device 11*b*.

While certain specific embodiments of the present invention have been disclosed as typical, the invention is of course not limited to these particular forms, but rather is applicable broadly to all such variations as fall within the scope of the appended claims.

I claim:

1. The combination comprising:

a baby walker having wheels for engaging a floor surface and moving therealong, and including a structure supported by said wheels for movement therewith and adapted to assist in supporting a baby in a position in which his feet can contact the floor surface and propel the walker therealong on said wheels; and a base panel adapted to be removably received in an active position in which it is supported on the floor surface independently of said wheels of the walker and extends generally horizontally beneath a baby supported by said structure at a location to be contacted by the feet of the baby above the floor surface and prevent his feet from engaging the floor in propelling relation;

said walker being disposed about said panel in said active position thereof in a relation to engage the periphery of the panel at different sides and thereby retain the walker against horizontal movement relative to the panel.

2. The combination as recited in claim 1, in which said walker has a frame carrying said wheels and extending therebetween and which extends essentially about said panel in said active position thereof to retain the walker against horizontal movement.

3. The combination as recited in claim 2, including holding elements carried by said panel at spaced locations and movable to positions above said frame to block upward removal thereof from the panel.

4. For use with a baby walker having wheels for engaging a floor surface and moving therealong, and including a structure supported by said wheels for movement therewith and adapted to assist in supporting a baby in a position in which his feet can contact the floor surface and propel the walker therealong on said wheels, a device for preventing movement of said walker comprising:

a base panel adapted to be removably received in a position in which it is supported on the floor surface independently of said wheels of the walker and extends generally horizontally beneath a baby supported by said structure at a location to be contacted by the feet of the baby above the floor surface and prevent his feet from engaging the floor in propelling relation;

said panel being essentially circular and receivable within an essentially circular frame of the walker in a relation retaining the walker against horizontal movement relative to the panel.

5. A device as recited in claim 4, including holding parts on said panel movable to positions above said frame to block upward removal of the walker from the panel.

6. For use with a baby walker having wheels for engaging a floor surface and moving therealong, and including a structure supported by said wheels for movement therewith and adapted to assist in supporting a baby in a position in which his feet can contact the floor surface and propel the walker therealong on said wheels, a device for preventing movement of said walker comprising:

a base panel adapted to be removably received in a position in which it is supported on the floor surface independently of said wheels of the walker and extends generally horizontally beneath a baby supported by said structure at a location to be contacted by the feet of the baby above the floor surface and prevent his feet from engaging the floor in propelling relation;

said panel having means engageable with said walker in a relation retaining the walker against horizontal movement relative to the panel;

said structure of the walker including a bottom frame extending between and connecting said wheels near the floor surface;

said means forming upwardly facing recesses on said panel for removably receiving said frame at spaced locations in an interfitting relation preventing horizontal movement of the walker relative to said panel.

7. A device as recited in claim 6, in which said means form restricted throats at upper ends of said recesses through which said frame can be forced downwardly and which are resiliently expansible by said frame in a relation releasably retaining the frame in said recesses.

8. A device as recited in claim 6, including an elongated flexible element for detachably connecting said panel to said walker.

9. For use with a baby walker having wheels for engaging a floor surface and moving therealong, and including a structure supported by said wheels for movement therewith and adapted to assist in supporting a baby in a position in which his feet can contact the floor surface and propel the walker therealong on said wheels, a device for preventing movement of said walker comprising:

a base panel adapted to be removably received in a position in which it is supported on the floor surface independently of said wheels of the walker and extends generally horizontally beneath a baby supported by said structure at a location to be contacted by the feet of the baby above the floor surface and prevent his feet from engaging the floor in propelling relation;

said panel having means engageable with said walker in a relation retaining the walker against horizontal movement relative to the panel;

said structure of the walker including a frame supported by and extending between said wheels;

said means including a plurality of recessed connector structures carried by said panel at circularly spaced locations and engageable with said frame of the walker in interfitting relation, at least one of said connector structures including a first part attached to the panel and a second part mounted to said first part for adjusting movement relative thereto.

10. The combination comprising:

a baby walker having wheels for engaging a floor surface and moving therealong, and including a structure supported by said wheels for movement therewith and adapted to assist in supporting a baby in a position in which his feet can contact the floor surface and propel the walker therealong on said wheels; and a base panel adapted to be removably received in a position in which it is supported on the floor surface independently of said wheels of the walker and extends generally horizontally beneath a baby supported by said structure at a location to be contacted by the feet of the baby above the floor surface and prevent his feet from engaging the floor in propelling relation;

said panel having means engageable with said walker in a relation retaining the walker against horizontal movement relative to the panel;

said structure including a bottom frame extending between and connecting said wheels near the floor surface;

said means forming upwardly facing recesses on said panel for removably receiving said frame at spaced locations in an interfitting relation preventing horizontal movement of the walker relative to said panel.

11. The combination as recited in claim 10, including means for releasably retaining said frame in said recesses.

12. The combination as recited in claim 10, including detenting means forming throats through which said frame can be forced downwardly and which are resiliently expansible by said frame in a relation releasably retaining the frame in said recesses.

13. The combination comprising:

a baby walker having wheels for engaging a floor surface and moving therealong, and including a structure supported by said wheels for movement therewith and adapted to assist in supporting a baby in a position in which his feet can contact the floor surface and propel the walker therealong on said wheels; and a base panel adapted to be removably received in a position in which it is supported on the floor surface independently of said wheels of the walker and extends generally horizontally beneath a baby supported by said structure at a location to be contacted by the feet of the baby above the floor surface and prevent his feet from engaging the floor in propelling relation;

said panel having means engageable with said walker in a relation retaining the walker against horizontal movement relative to the panel;

said structure including a lower ring extending between and interconnecting and supported by said wheels and located near the floor surface, a top spaced above said ring and containing an opening within which a baby is supported, and legs for supporting said top from said ring;

said means including a plurality of posts projecting upwardly from said panel at circularly spaced locations and containing upwardly facing recesses dimensioned and positioned to receive portions of said ring at circularly spaced locations in an interfitting relation holding the walker against horizontal movement relative to said panel;

said posts having upper portions forming a throat therebetween of a dimension slightly smaller than said ring and adapted to be resiliently spread apart when the ring is forced downwardly therebetween and to then return resiliently toward one another to releasably detent the ring in said recesses.

14. A device as recited in claim 4, including means for releasably retaining said walker against upward separation from said panel.

15. A device as recited in claim 6, including means for releasably retaining said walker against upward separation from said panel.

* * * * *